US008667615B2

(12) United States Patent
Vanderburgh

(10) Patent No.: US 8,667,615 B2
(45) Date of Patent: Mar. 11, 2014

(54) PAIR OF PANTS AND METHOD FOR DONNING AND REMOVING A PAIR OF PANTS

(76) Inventor: Patricia Lynn Vanderburgh, Dayton, OH (US)

( * ) Notice: Subject to any disclaimer, the term of this patent is extended or adjusted under 35 U.S.C. 154(b) by 0 days.

(21) Appl. No.: 13/162,817

(22) Filed: Jun. 17, 2011

(65) Prior Publication Data

US 2012/0317700 A1 Dec. 20, 2012

(51) Int. Cl.

| | |
|---|---|
| ***A41D 1/06*** | (2006.01) |
| ***A41D 13/02*** | (2006.01) |
| ***A41F 9/00*** | (2006.01) |

(52) U.S. Cl.

USPC ..... 2/237; 2/79; 2/227; 2/236

(58) Field of Classification Search

USPC ..... 2/79, 76, 219, 220, 221, 227, 235, 236, 2/237

See application file for complete search history.

(56) References Cited

U.S. PATENT DOCUMENTS

| | | | | |
|---|---|---|---|---|
| 2,483,076 | A * | 9/1949 | Vacca | 2/67 |
| 2,580,774 | A * | 1/1952 | Helbig | 2/212 |
| 2,799,022 | A * | 7/1957 | Parise | 2/76 |
| 2,900,643 | A * | 8/1959 | Varnhagen | 2/221 |
| 4,106,125 | A * | 8/1978 | Palumbo | 2/213 |
| 4,389,733 | A * | 6/1983 | Boykins, Jr. | 2/466 |
| 4,506,391 | A | 3/1985 | Rodman | |
| 5,033,124 | A | 7/1991 | Bucalo et al. | |
| 6,041,441 | A | 3/2000 | Counts et al. | |
| 6,119,274 | A | 9/2000 | Graham | |
| 6,338,164 | B1 | 1/2002 | Howard | |
| 6,675,389 | B1 | 1/2004 | Kublick | |
| 7,814,574 | B2 | 10/2010 | Gheneva | |
| 7,832,022 | B1 | 11/2010 | Peters | |

OTHER PUBLICATIONS http://www.nextag.com/tear-away-pants/shop-html—at least as early as Jan. 2009.

http://basketball.epicsports.com/trk5093525/prod/4526/a4-adult-dazzle-tear-away-basketball-pants.html—at least as early as Sep. 2010.

(Continued)

*Primary Examiner* — Amber Anderson

(74) *Attorney, Agent, or Firm* — Jacox, Meckstroth & Jenkins

(57) ABSTRACT

A pair of pants that allows a wearer to easily don and remove the pair of pants while the wearer wears other articles of clothing, apparel or footwear (such as shorts, gym shoes, golf shorts or boots), a cast, a leg brace or the like. The pair of pants has a waistband that encircles a waist of the wearer of the pair of pants, a first leg having a first inner leg seam and a first outside leg opening, a second leg having a second inner leg seam and a second outside leg opening, a crotch seam between the first and second legs, the pair of pants being made of a fabric that is slidably supported on the waistband, at least a portion of the pair of pants enabling the fabric to slidably move on the waistband to enable the wearer to increase a size of at least one of the first outside leg opening or the second outside leg opening to facilitate the easy donning and removal of the pants. The pants have overlapping portions or wings that can wrap around the pants to close the first and second outside leg openings.

48 Claims, 9 Drawing Sheets

(56) References Cited

OTHER PUBLICATIONS http://store.nike.com/us/en_us/?cp=usns_CSE_081109_NexTag&l=shop,pdp,ctr-inline/cid-100701/pid-336780/pgid-410705#l=shop,pdp,ctr-inline/cid-100701/pid-336780/pgid-410705—at least as early as Dec. 2008.
http://www.budovideos.com/shop/customer/product.php-?productid=28554&utm_medium=shoppingengine&utm_source=nextag&source=nextag—at least as early as Feb. 2010.
http://www.dogfunk.com/airblaster-finisher-pant-mens?CMP_SKU=ABT0163&MER=0406&CMP_ID=SH_NXT003&mv_pc=r147&mr:referralID=3fa6498f-4efd-11e0-b827-001b2166c62d—at least as early as Oct. 2010.
http://www.dogfunk.com/technine-tear-away-insulated-snowboard-pant-mens?CMP_SKU=TCNO200&Mer=0406&CMP_ID=SH_NXT003&mv_pc=r147&mr:referralID=91ad1e7b-4efd-11e0-a86a-001b2166c2c0—at least as early as Dec. 2010.
http://compare.ebay.com/like/370490035367?Ityp=AllFixedPriceItemTypes&var=sbar—at least as early as Oct. 2010.
http://esiamcenter.com/shop/wrap-pants-tie-pants-skirt-pant-c-72_166/fl124-spring-beige-skirt-pant-wrap-around-pants-p-1408?currency=USD—at least as early as Feb. 2009.
www.purpleunicorn.com/wraps.html—at least as early as Oct. 2006.
http://www.karatesupply.com/Hakama-Pants_p_546.html—at least as early as Dec. 2010.
www.alonatwotrees.com/library/howto/hakama.pdf—at least as early as Jan. 2009.
http://www.leatherup.com/p/Leather-Chaps--pants/Best-Seller-Mens-Premium-Motorcycle-Easy-Fit-Chaps-with-Zipper-On-Thigh/41237.html—at least as early as Apr. 2008.
http://www.adaptiveclothingshowroom.com/index1.html?1175.html&1—at least as early as Jan. 2007.

* cited by examiner

PAIR OF PANTS AND METHOD FOR DONNING AND REMOVING A PAIR OF PANTS

BACKGROUND OF THE INVENTION

1. Field of the Invention

This invention relates to pants and, more particularly, to a pair of pants having a waistband and closeable side leg openings that facilitate donning and without removing other worn footwear or apparel.

2. Description of the Related Art

Current outerwear over shorts or pants is difficult to remove and don over footwear and other articles of clothing. There are two major types of outerwear pants: one that contains a continuous elastic or tie waistband, such as sweatpants. One limitation of the continuous waistband pants (sweatpants) is the difficulty of donning without having the under clothing bunching up. A second limitation is that the pants cannot be easily donned while wearing footwear. Often, footwear needs to be removed or one must be seated to don or remove these pants.

Another type of outerwear pants is one that has a waistband and pant legs that can open and close on the sides via snaps or Velcro®, such as the Adidas® branded, Model No. 100G. The side-opening waistband pants (e.g., tear-away basketball pants) are rather time consuming to don since they require many individual snaps or the proper aligning of Velcro® strips. Because they have no continuous waistband that allows the pants to stay at or on the individual's waist, one must hold them while putting them on. Lastly, there is still the difficulty with the leg opening size and getting footwear in and out, unless the pant leg is completely unsnapped, which adds to the time consuming aspect of the pants.

SUMMARY OF THE INVENTION

It is, therefore, a primary object of the invention to provide a pair of pants that can be easily donned and removed over other articles of clothing or footwear.

Another object of one embodiment of the invention is to provide a pair of pants having a waistband that supports the pants on the waist while the side leg openings may be opened or closed.

Another object of an embodiment of the invention is to provide a pair of pants having side leg openings and at least one or a plurality of wings or wrap-over portions that can be used to close the side leg openings.

Still another object of an embodiment of the invention is to provide a pair of pants having at least one or a plurality of wings or wrap-around portions that can be wrapped from back to front to facilitate closing the side leg openings.

Yet another object of an embodiment of the invention is to provide a pair of pants having at least one or a plurality of wings or wrap-around portions that are not affixed to the waistband but that move in response to movement of material to which the at least one or a plurality of wings or wrap-around portions are integrally formed or secured.

In one aspect, one embodiment comprises a pair of pants that allow a wearer to easily don and remove the pair of pants without the wearer having to remove clothing, apparel, footwear, skates, a cast, a leg brace or the like, the pair of pants comprising a waistband that encircles a waist of the wearer of the pair of pants, a first leg having a first inner leg seam and a first outside leg opening, a second leg having a second inner leg seam and a second outside leg opening, a crotch seam between the first and second legs, the first leg and the second leg being made of a fabric that is slidably supported on the waistband and that define a front and a back of the pair of pants, at least a portion of the pair of pants enabling the fabric to slidably move on the waistband to enable the wearer to increase a size of at least one of the first outside leg opening or the second outside leg opening.

In another aspect, another embodiment comprises a pair of pants comprising a first portion and a second portion, a waistband; the first portion and the second portion slidably received or mounted on the waistband, a first leg extending from the first and second portions and having a first leg side opening, a second leg extending from the first and second portions and having a second leg side opening, the first and second portions adapted to be slidably moved on the waistband to enable the wearer to increase a size of at least one of the first leg side opening or the second leg side opening.

In still another aspect, another embodiment comprises a method for donning a pair of pants having a first leg side opening and a second leg side opening, the method comprising the steps of increasing a size of at least one of the first leg side opening or the second leg side opening by either sliding a first portion and a second portion on a waistband or stretching the waistband, inserting a first leg into the waistband and into one of the first leg side opening or second leg side opening, sliding the first portion and the second portion on the waistband to increase a size of the other of the first leg side opening or second leg side opening by sliding a first portion and a second portion on a waistband or stretching the waistband, inserting a second leg into the other of the first leg side opening or second leg side opening, pulling the waistband over a waist of the wearer, sliding the first portion and the second portion closer together to close the at least one of the first leg side opening or the second leg side opening, sliding the first portion and the second portion of the other of the first leg side opening or second leg side opening closer together to close the opening of the first leg side opening or the second leg side opening, wrapping a first wrap-around portion of at least one of the first portion or second portion about the second portion or first portion, respectively, to substantially close the first leg side opening, wrapping a second wrap-around portion of at least one of the first portion or second portion about the second portion or first portion, respectively, to substantially close the second leg side opening.

In yet still another aspect, another embodiment comprises a pair of pants comprising a waistband, a first portion slidably received or mounted on the waistband, and a second portion slidably received or mounted on the waistband, the first and second portions being coupled to or integral with a first pant leg having a first side opening and a second pant leg having a second side opening, the first and second portions being slidably supported on the waistband so that the first and second portions can be slidably moved away from or towards each other on the waistband or the waistband can stretch or contract to enable a wearer to increase or decrease, respectively, a size of at least one of the first side opening or the second side opening to facilitate easy donning and removal of the pair of pants by a wearer while the wearer wears other apparel or footwear.

An embodiment of the invention is aimed at reducing or eliminating these limitations of current outerwear pants. There is a continuous waistband that allows pants to stay at a person's waist without holding the pants up with hands. There are sliding side openings on each side of the waistband to the very bottom of the outside of each leg, which allow for very easing donning and removing while wearing footwear. Also, since the side fabric can be slid almost completely opened one can easily straighten out any under clothing that may have bunched up while donning the pants. The wrap around style of the pant also ensures complete closure on the sides of the legs and lower torso, once they are wrapped around to the front and secured with as few as two closures (snaps, Velcro, buttons, etc.).

These and other objects and advantages of the invention will be apparent from the following description, the accompanying drawings and the appended claims.

DETAILED DESCRIPTION OF THE PREFERRED EMBODIMENT

Referring now to FIGS. 1-13E, a pair of pants 10 and method for donning and removing the pair of pants 10 is shown. In the illustration being described the pair of pants 10 allows or permits a wearer to easily don and/or remove the pair of pants 10 while wearing other articles of clothing, such as pants 12 (FIG. 13A), footwear 14 or other items, such as a leg brace (not shown), a cast (not shown) or the like.

Figure 1:
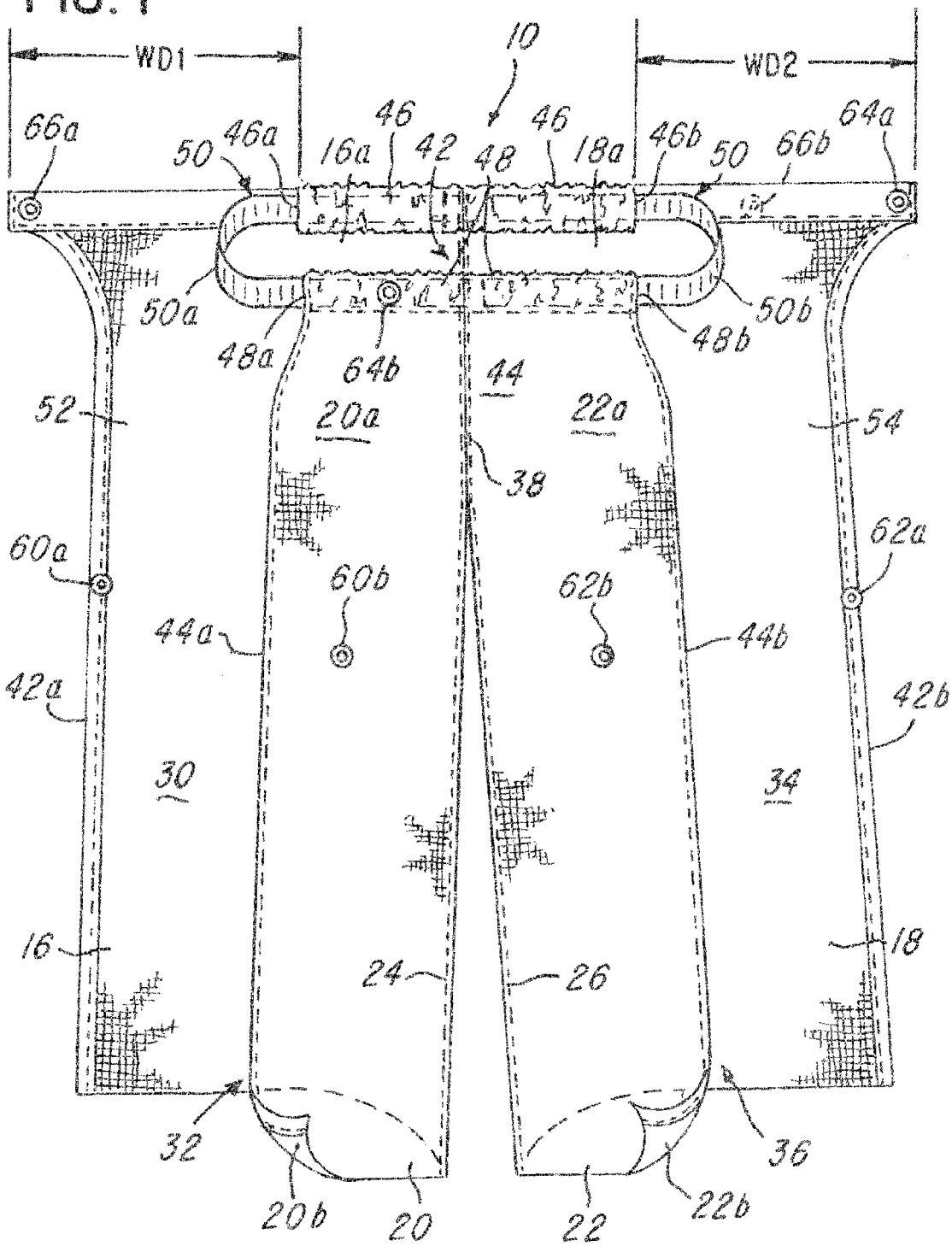
FIG. 1 is a plan view of a pair of pants in accordance with one embodiment of the invention.
Figure 2:
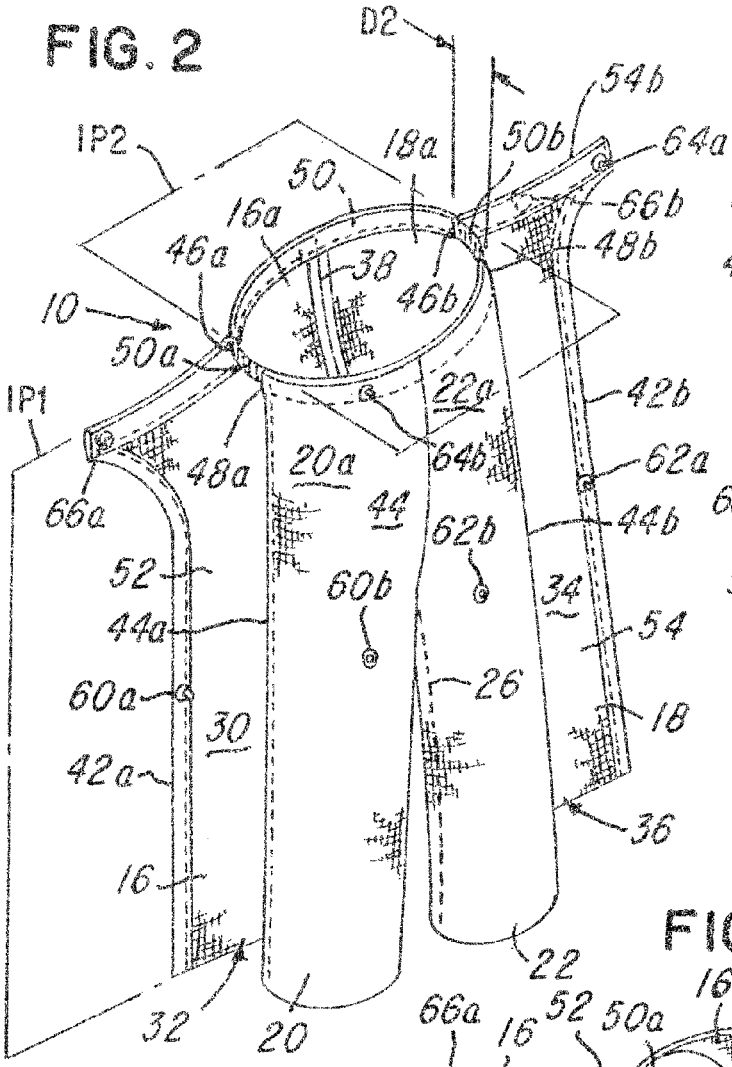
FIG. 2 is a perspective view of the pair of pants shown in FIG. 1.
Figure 3:
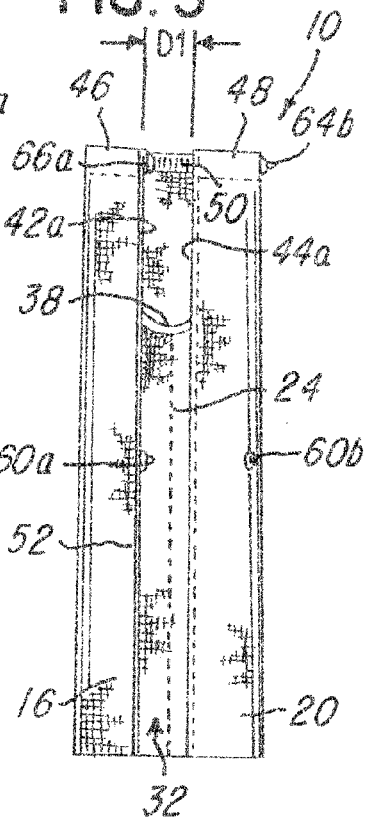
FIG. 3 is a left-side view of the pair of pants shown in FIG. 2.
Figure 4:
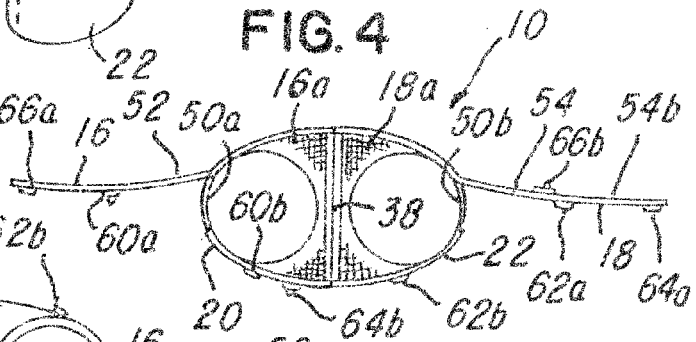
FIG. 4 is a top view of the pair of pants shown in FIG. 2.
Figure 5:
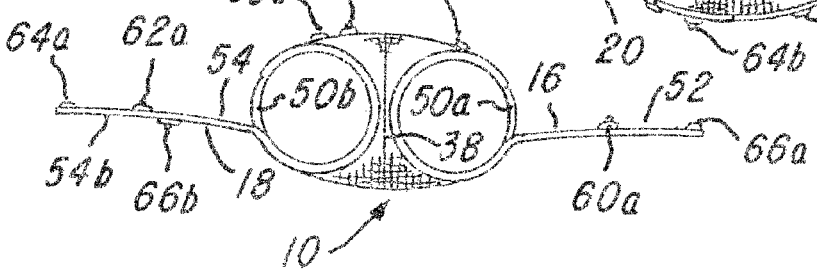
FIG. 5 is a bottom view of the pair of pants shown in FIG. 2.

The pair of pants 10 comprises a plurality of pant pieces sewn together in the embodiment being described to provide the pair of pants 10. In the illustration being described, the plurality of pant pieces comprises a first back pant piece 16, a second back pant piece 18, a first front pant piece 20 and a second front pant piece 22. In the illustration being described, the first front pant piece 20 is sewn to the first back pant piece 16 at an inseam 24, and the second front pant piece 22 is sewn to the second back pant piece 18 to provide a second inseam 26, as illustrated in FIGS. 1, 2 and 3. It should be understood that the first back pant piece 16 and first front pant piece 20 cooperate and are adapted to define a first leg 30 having a first outside leg opening 32. Likewise, the second back pant piece 18 and second front pant piece 22 cooperate and are adapted to define a second leg 34 having a second outside leg opening 36, as best illustrated in FIGS. 1 and 2. The first leg 30 and the second leg 34 are coupled or sewn together at a crotch seam 38 as best illustrated in FIGS. 1, 2, 4 and 5.

The first back pant piece 16 comprises a first upper portion or area 16*a* that is sewn to a second upper portion or area 18*a* of a second back pant piece 18. The first and second upper portions 16*a* and 18*a* cooperate to define a first portion or rear portion 42. As best illustrated in FIG. 1, the first front pant piece 20 comprises an upper portion or area 20*a* that is secured to an upper portion or area 22*a* of the second front pant piece 22. The upper portions or areas 20*a* and 22*a* are secured by conventional means, such as by the crotch seam 38 and cooperate to define a second portion or front portion 44 as shown.

Figure 7:
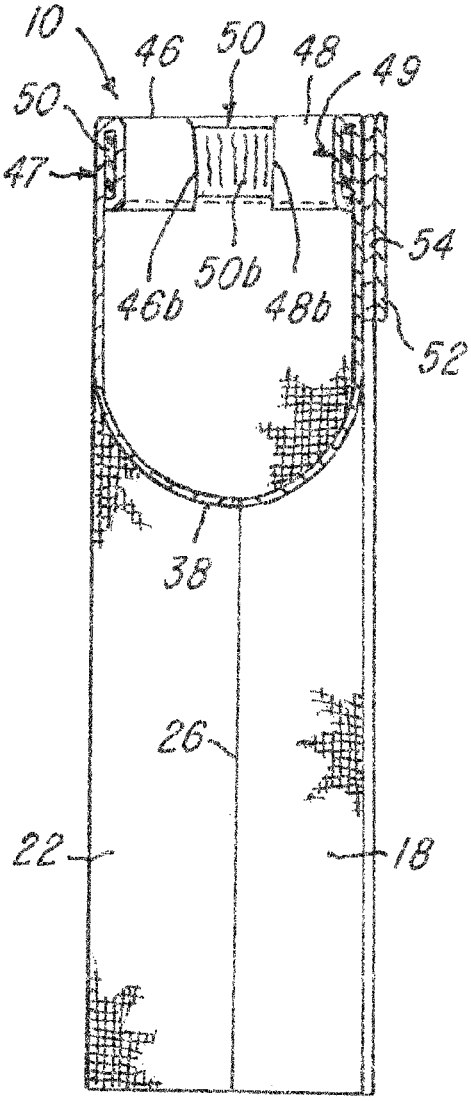
FIG. 7 is a sectional view taken along the line 7-7 in FIG. 6.
Figure 8:
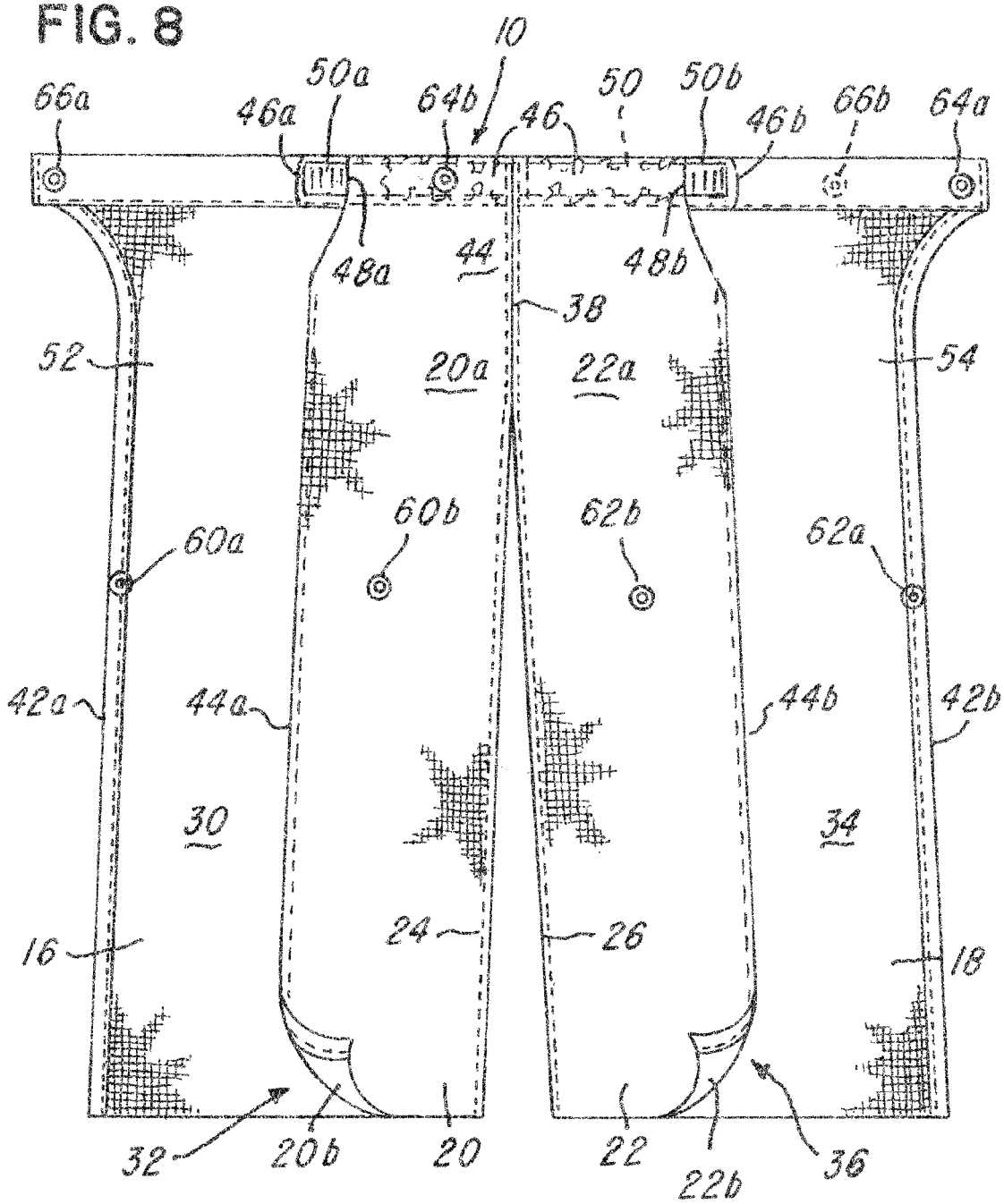
FIG. 8 is a front view of the pair of pants shown in FIG. 1.
Figure 9:
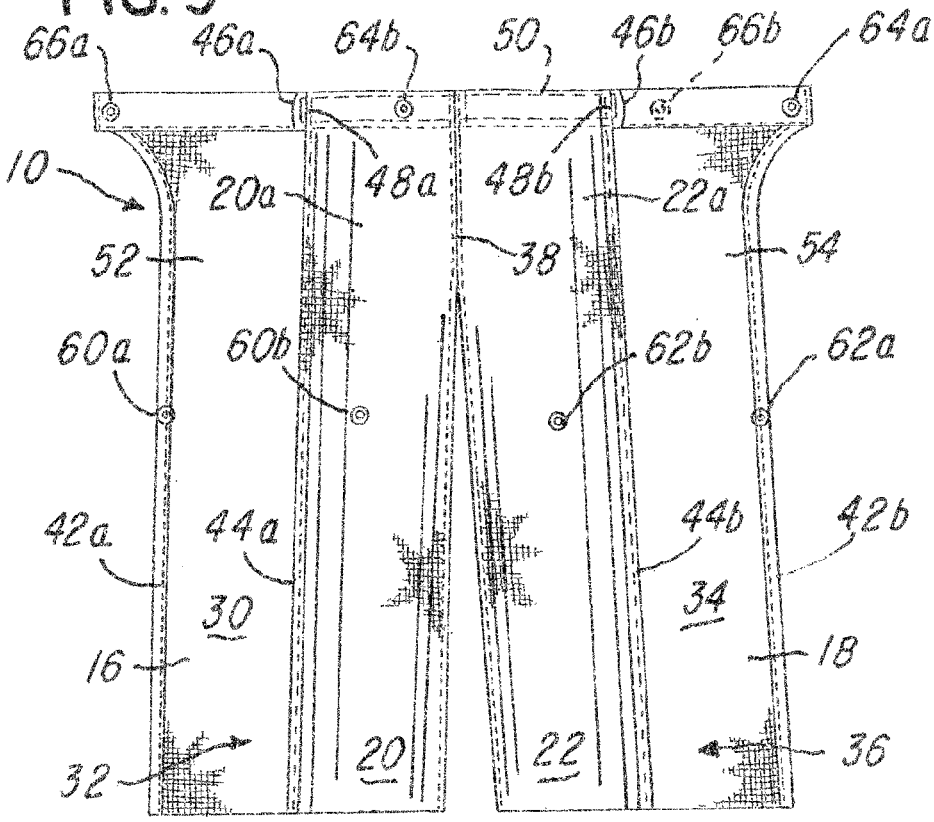
FIG. 9 is a front view of the pair of pants shown in FIGS. 1 and 8, illustrating an ornamental design in accordance with one embodiment.
Figure 10:
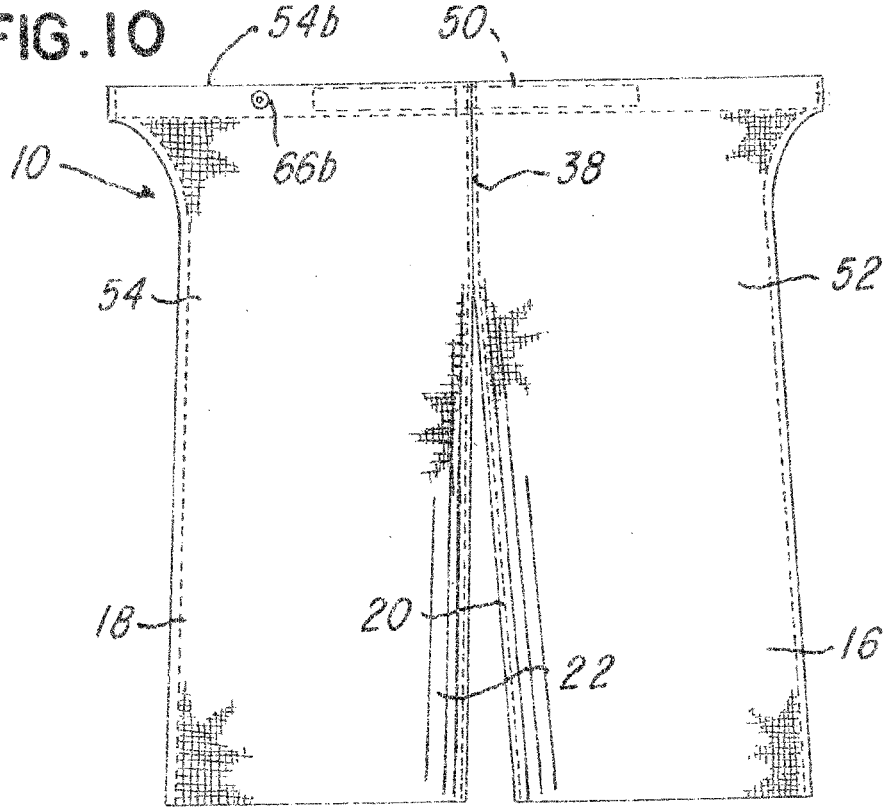
FIG. 10 is a rear view of the pair of pants shown in FIGS. 1 and 8.
Figure 11:
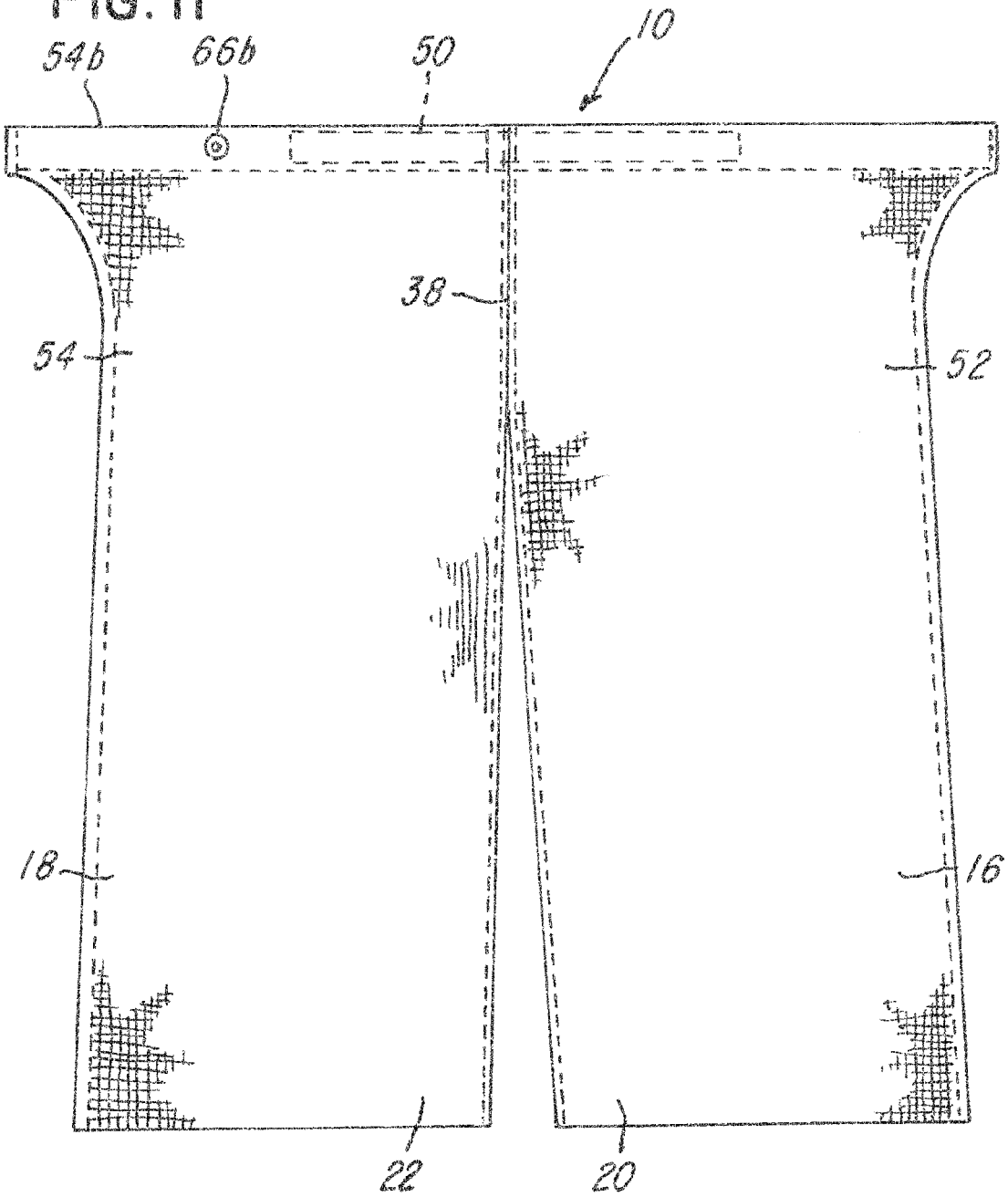
FIG. 11 is an enlarged view of the pair of pants shown in FIG. 10.

The first portion or rear portion 42 comprises a first hem or seam 46 which is best illustrated in FIGS. 1 and 7. Likewise, the second portion or front portion 44 comprises a second hem or seam 48. In the illustration being described, the first and second hems or seams 46 and 48 define receiving areas 47 (FIG. 7) and 49, respectively, for receiving a waistband 50. The first and second seams 46 and 48 are formed by an overlapping portion that is sewn at edges 46*b* and 48*b*, respectively, to define the first and second hems or seams 46 and 48, respectively. In one embodiment, the waistband 50 is a continuous and elastic waistband, but it could be a non-continuous waistband or a waistband that is not entirely elastic.

The hem or seam 46 of the first portion or rear portion 42 is slidably received on the waistband 50 and the hem or seam 48 associated with the second portion or front portion 44 is slidably received on the waistband 50. It should be understood that at least a portion of the second portion or front portion 44 and the first portion or rear portion 42 is movably or slidably received on the waistband 50. Note that the waistband 50 comprises a first exposed waistband area 50*a* and a second exposed waistband area 50*b* that is in communication with the first outside leg opening 32 and second outside leg opening 36, respectively. The advantage of this design is described later herein.

The first leg 30 and first portion or rear portion 42 comprises at least one first wing or wrap-around portion 52. The second leg 34 and the second portion or front portion 44 comprises at least one second wing portion or wrap-around portion 54, as illustrated in FIGS. 1 and 2. The at least one first wing portion or wrap-around portion 52 cooperates with the first front pant piece 20 to define the first outside leg opening 32 and the second back pant piece 18 and at least one second wing portion or wrap-around portion 54 cooperates with the second front pant piece 22 to define the second outside leg opening 36 as shown.

In the illustration being described, note that the first portion or rear portion 42 comprises a first edge 42*a* and the second portion or front portion 44 comprises a second edge 44*a* as shown. The first and second edges 42*a* and 44*a* cooperate to define the first outside leg opening 32. Likewise, the first portion or rear portion 42 further comprises a third edge 42*b* and the second portion or front portion 44 comprises the fourth edge 44*b*. The third edge 42*b* and fourth edge 44*b* cooperate to define the second outside leg opening 36 as shown. The first edge 42*a* and second edge 44*a* define a separation distance D1 (FIG. 3) that also defines an opening into the first outside leg opening 32. Similarly, the third edge 42*b* and fourth edge 44*b* cooperate to define a separation distance D2 (FIG. 2) as shown.

The at least one first wing portion or wrap-around portion 52 is defined by the portion of the first portion or rear portion 42 that extends to a left (as viewed in FIG. 1) of the edge 46*a* of hem 46 a predetermined wing distance WD1 as shown. Likewise, the at least one second wing portion or wrap-around portion 54 is defined by the portion of the at least one first panel or back panel that extends beyond the edges 46*b* of hem or seam 46 a predetermined wing distance WD2 as shown.

It should be understood that the hems or seams 46 and 48 enable the first portion or rear portion 42 and second portion or front portion 44, respectively, to slidably move or ride along the waistband 50 so that the separation distances D1 and D2 may be increased or decreased. Alternatively, if the waistband 50 is, for example, a continuous elastic waistband, the elastic can be stretched at the first exposed waistband area 50*a* or second exposed waistband 50*b* to increase the separation distances D1 and D2 to facilitate donning and removing the pair of pants 10 as described later herein.

The pair of pants 10 comprises a plurality of fasteners, which in the embodiment being described are shown as snap fasteners, but could be any suitable fasteners, such as buttons, snaps, buckles, ties, Velcro®, clasps or other conventional fasteners that facilitate fastening the first wing portion or wrap-around portion 52 and the second wing portion or wrap-around portion 54 in the closed position illustrated, for example, in FIGS. 6, 7, 13D and 13E. In the illustration being described, the embodiment comprises a first pair of snaps 60*a*, 60*b*, a second pair of snaps 62*a*, 62*b*, a third pair of snaps 64*a*, 64*b*, and a fourth pair of snaps 66*a*, 66*b* that are used to fasten or lock the first and second wing portions or wrap-around portions 52 and 54 in the closed position.

In the illustration being described, the pair of pants 10 are made from a fabric material, such as a cotton fabric material, but they could be made from any suitable material, such as Gortex®, fleece, spandex, polartec, nylon, polyester, Kevlar® or the like. The material could also be seasonal wear, industrial wear, farm wear, rain wear, thermal wear or other sports wear. Also, the material could comprise any desired pattern, such as an aesthetic floral or feminine pattern, masculine pattern, such as a sports theme pattern, camouflage pattern or the like, or they could be provided in a plain color pattern, such as black.

As mentioned earlier, one advantageous feature of the embodiment being described is that at least a portion of the pair of pants 10 enables the fabric to slidably move on the waistband 50 to enable the wearer to increase a size of at least one of the first outside leg opening 32 or the second outside leg opening 36 by either stretching the waistband 50 at the areas 50*a* or 50*b* or by moving and bunching the fabric along the waistband 50. For example, the wearer or user may move the edge 46*a* of hem or seam 46 and the edge 48*a* of hem or seam 48 slidably apart on the waistband 50 (as viewed in FIG. 1), thereby increasing the separation distance D1 and thereby increasing the size of the first outside leg opening 32.

Likewise, the edges 46*b* of hem or seam 46 and edge 48*b* of hem or seam 48 may be slidably moved apart on the waistband 50, or the elastic waistband 50 may be stretched at area 50*b*, to increase the second separation distance D2 which in turn increases the size of the second outside leg opening 36. Thus, it should be understood that the first portion or rear portion 42 and the second portion or front portion 44 are slidably supported on the waistband 50 so that the first portion or rear portion 42 and second portion or front portion 44 can be slidably moved toward or away from each other on the waistband 50 or the waistband 50 can be stretched to enable the wearer to increase or decrease, respectively, a size of at least one of the first outside leg opening 32 or second outside leg opening 36 to facilitate easy donning and removal of the pair of pants 10 by a wearer. This facilitates the wearers' easy donning or removal of the pair of pants 10 while the wearer wears other articles of clothing, apparel or footwear, such as boots, gym shoes, athletic shoes, golf spikes, skates, a cast, a leg brace or other items.

The first wing portion or wrap-around portion 52 and the second wing portion or wrap-around portion 54 wrap around to the second portion or front portion 44 to close the first outside leg opening 32 and second outside leg opening 36, respectively, as illustrated in FIGS. 13A-13E. It is important to observe that at least one first wing portion or wrap-around portion 52 and one second wing portion or wrap-around portion 54 extend beyond the edges 46*a* and 46*b* as illustrated in FIG. 1 and are not slidably mounted on the waistband 50. However, the first wing portion or wrap-around portion 52 and the second wing portion or wrap-around portion 54 move in response to movement of the first edge 46*a* and second edge 46*b*, respectively, of the hem or seam 46 on the waistband 50. As best illustrated in FIG. 2, the first wing portion or wrap-around portion 52 and the second wing portion or wrap-around portion 54 lie in an imaginary plane IP1 that is generally perpendicular to an imaginary plane IP2 in which the waistband 50 lies.

Figure 13A:
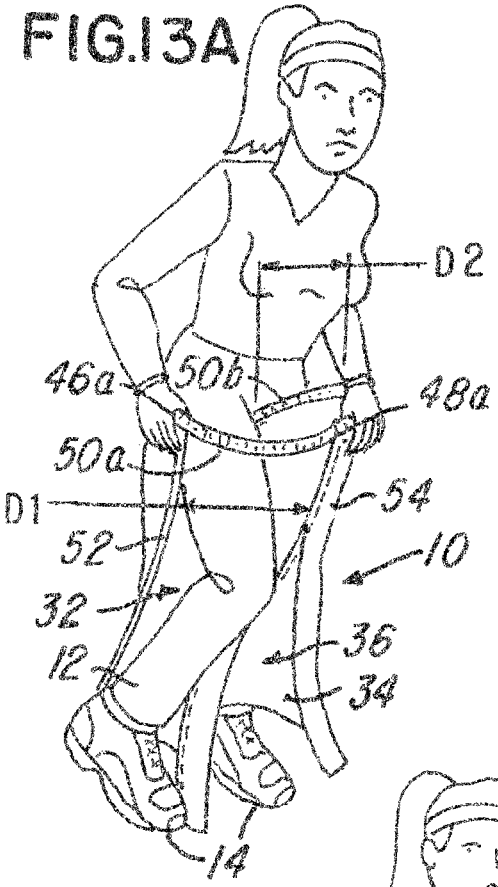
FIGS. 13A-13E illustrate a method or process for donning one embodiment of the invention.

Donning and/or removing the pair of pants 10 will now be described relative to FIGS. 13A-13E. First a size of the separation distance D1 may be increased, if necessary, which, in turn increases the size of the first outside leg opening 32 to provide a larger opening so that the wearer can easily and quickly insert her leg into the first front pant piece 20. In order to increase the size of the separation distance D1, the wearer or user may cause the first edge 46*a* of hem or seam 46 and first edge 48*a* of hem or seam 48 to slidably move away from each other along the waistband 50, thereby increasing the separation distance D1 and the size of the first outside leg opening 32 as illustrated in FIG. 13A. In addition to or alternatively, the wearer may cause the separation of the edges 46*a* and 48*a* by stretching the waistband 50, for example, by stretching the area 50*a*. The user or wearer would then insert her leg into the first outside leg opening 32 as shown. Advantageously, in the illustration being described, the pair of pants 10 comprises no outside seams, but only the inseams 24 and 26 and the crotch seam 38.

A similar procedure is followed for the second leg of the user, with the user having the capability of moving or slidably moving the edges 46*b* of hem 46 and 48*b* of hem 58 away from each other on their respective hems 46 and 48 by stretching the area 50*b* in order to increase the second separation distance D2 and the size of the second outside leg opening 36. The user inserts her other leg into the second outside leg opening 36 and into the second leg 34.

After the user has inserted her legs into the first and second outside leg openings 32 and 36, the waistband 50 is pulled around the user's waist to support and hold the pair of pants 10 on the wearer. Advantageously, this enables the pair of pants to be supported on the waistband 50 with the wearer's hands being free and while the user closes the first wing portion or wrap-around portion 52 and the second wing portion or wrap-around portion 54. After the waistband 50 is supported on the waist, the user or wearer may optionally slidably move the edges 46*a*, 48*a* of hems 46 and 48 closer together and toward each other to facilitate closing the first outside leg opening 32 before the at least one second wing portion or wrap-around portion 54 is wrapped or moved to the closed position shown in FIGS. 13D and 13E. Likewise, the second edge 46*b* of hem or seam 46 and the second edge 48*b* of hem or seam 48 may be slidably moved closer together in order to facilitate closing the second outside leg opening 36 before the first wing portion or wrap-around portion 52 is wrapped around to the closed position shown in FIGS. 13D and 13E. Again, and as mentioned earlier herein, the at least one first wing portion or wrap-around portion 52 and the second wing portion or wrap-around portion 54 are not affixed to or supported by the waistband 50, but move in response to the movement of the edges 46*a* and 46*b*, respectively.

Figure 13B:
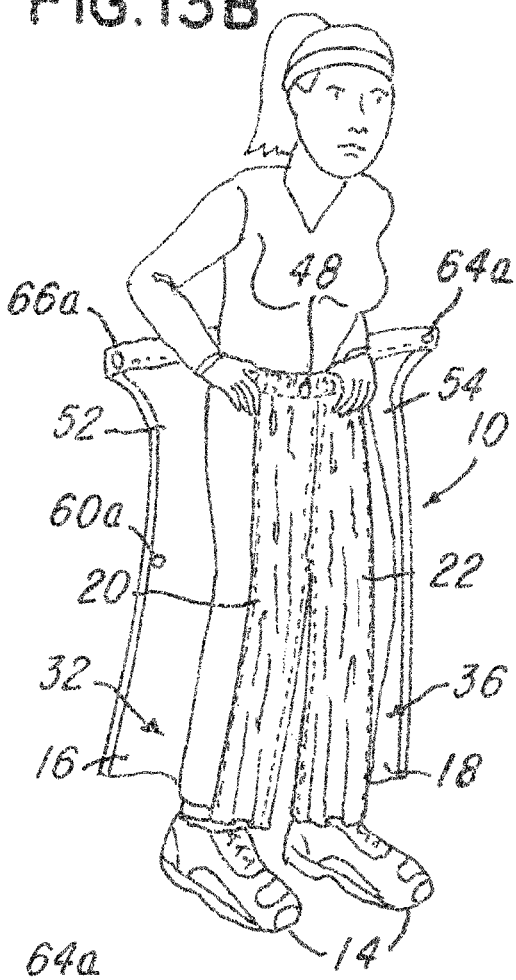
Figure 13C:
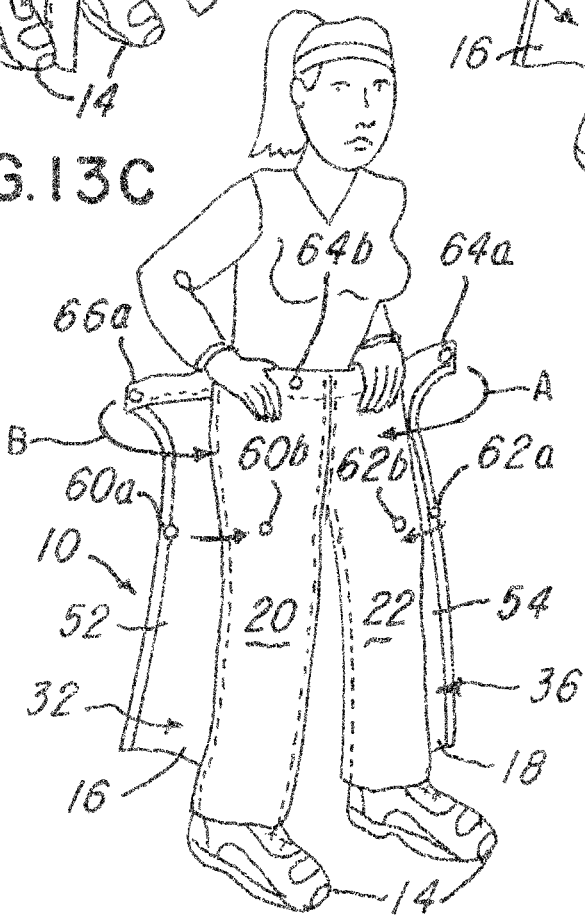
Figure 13D:
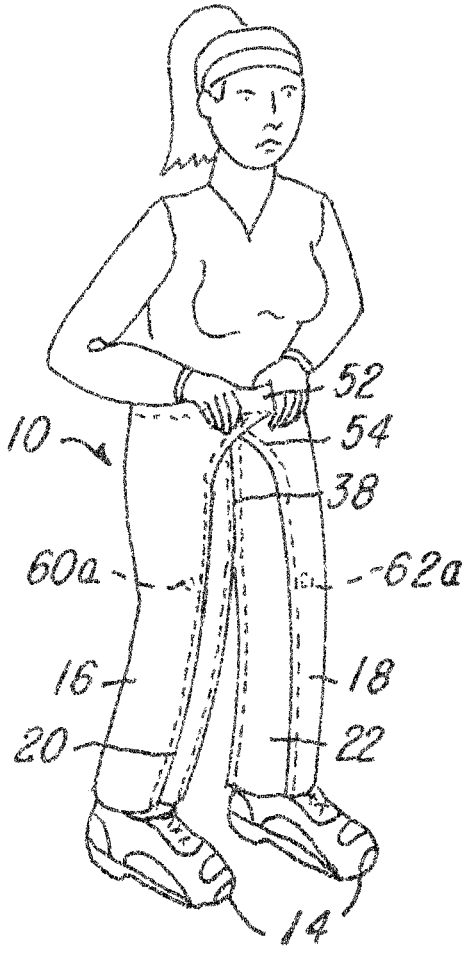
Figure 13E:
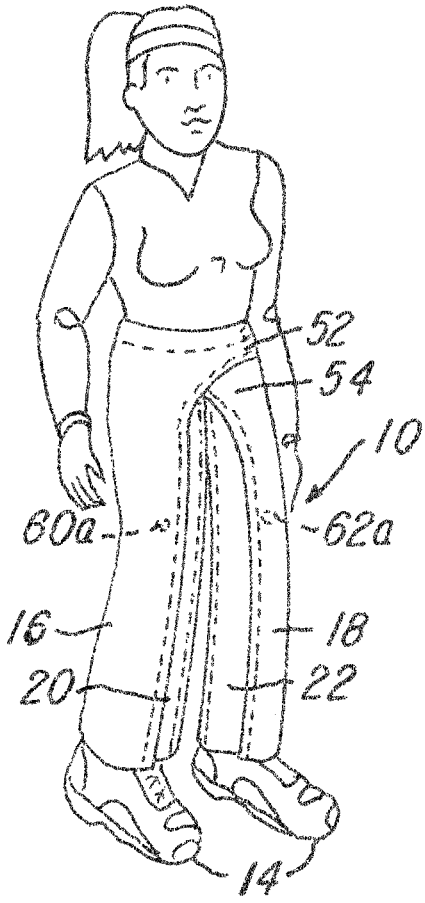

After the pair of pants 10 are supported on the user by the waistband 50 and the first and second outside leg openings 32 and 36 are at least partially or fully closed, the user can begin moving the first wing portion or wrap-around portion 52 and the second wing portion or wrap-around portion 54 from an open position shown in FIGS. 13B and 13C to a closed position shown in FIGS. 13D and 13E. In the illustration being described, the user or wearer grasps the second wing portion or wrap-around portion 54 and pulls it across the waist in the direction of arrow A in FIG. 13C and over the front portion 44. The user fastens the snaps 64*a* and 64*b* together. The user may then snap the snaps or fasteners 62*a* and 62*b* together at which point the second outside leg opening 36 becomes substantially closed. Note that during this wrapping of the second wing portion or wrap-around portion 54, the waistband 50 supports the pants 10 on the waist so that both of the user's hands are free to facilitate wrapping and fastening the second wing portion or wrap-around portion 54.

Thereafter, the user grasps the first wing portion or wrap-around portion 52 and moves it in the direction of arrow B in FIG. 13C and wraps it over the front portion 44 and snaps the snaps 66*a* and 66*b*. In this illustrative embodiment, note that the snap 66*b* is mounted on a rear side 54*b* (FIG. 2) of the second wing portion or wrap-around portion 54. The user may then snap or close the fasteners 60*a* and 60*b* together and whereupon the first outside leg opening 32 becomes substantially closed. After the fasteners 60*a*, 60*b*, 62*a*, 62*b*, 64*a*, 64*b*, 66*a* and 66*b* are fastened, the pair of pants 10 are in the closed and fastened position as illustrated in FIG. 13E. The user can remove the pants by substantially reversing the procedure.

Figure 6:
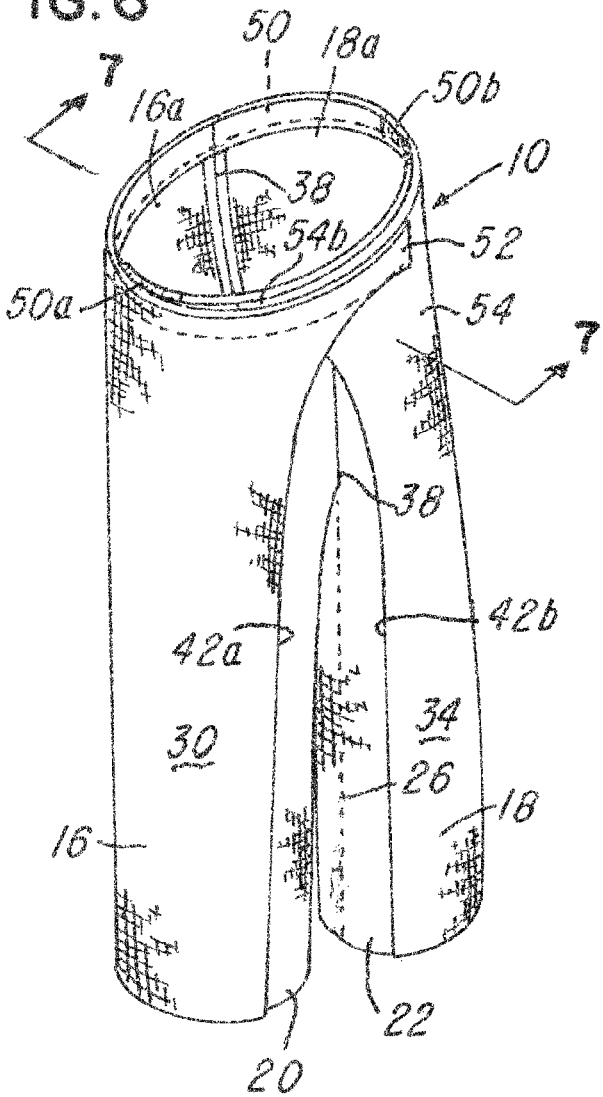
FIG. 6 is a perspective view of the pair of pants shown in FIG. 2 after the first and second wing portions or wrap-around portions are moved to a closed position.

FIG. 6 is another illustration of the pair of pants 10 in the closed position, with FIG. 7 being a fragmentary sectional view showing various details of the pair of pants 10.

Figure 12A:
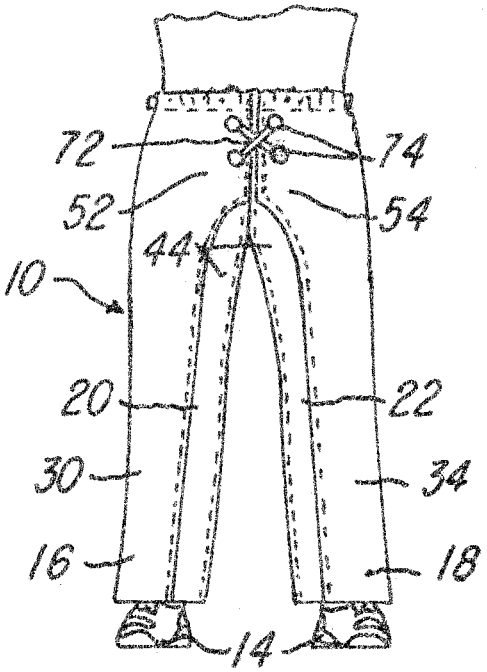
FIGS. 12A-12D are different views of various overlapping embodiments.
Figure 12C:
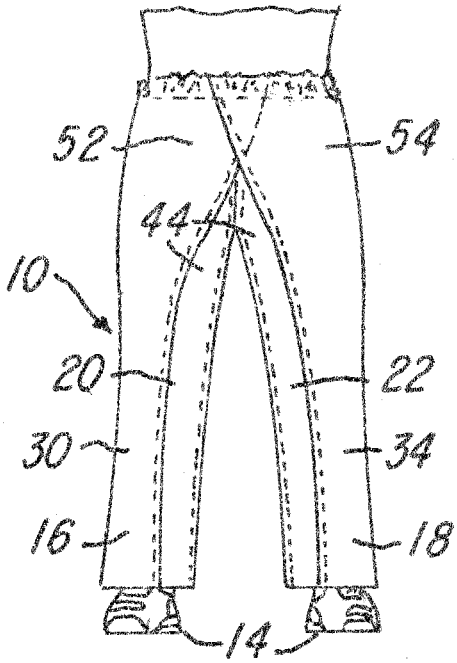
Figure 12B:
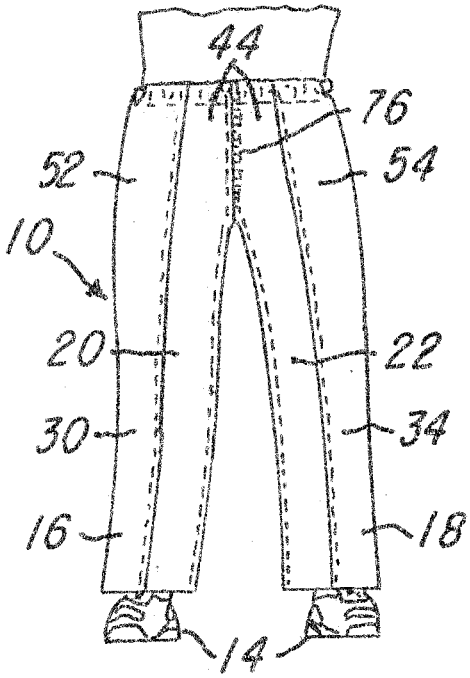
Figure 12D:
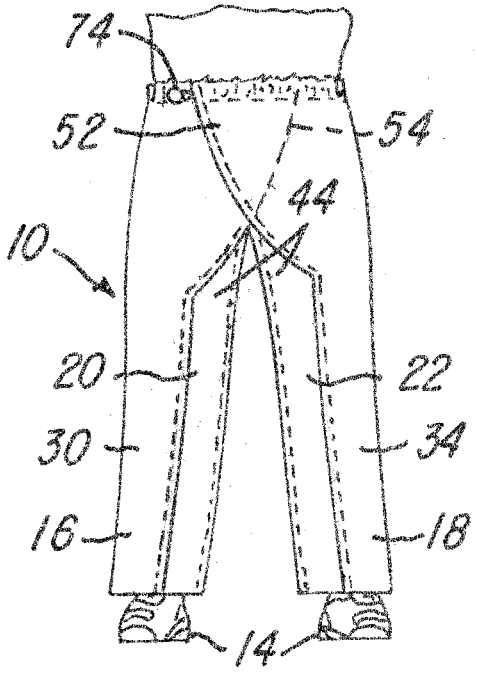

The inventor envisions that the fastening could comprise various types of fastening and overlapping portions, such as a small overlapping portion shown in FIG. 12C or a large overlapping portion shown in FIG. 12D that is used with at least one button or a plurality of ties 72 used with buttons 74 to secure the first wing portion or wrap-around portion 52 and/or the second wing portion or wrap-around portion 54 to the front portion 44 of the pair of pants 10. FIG. 12B also illustrates that a zipper 76 may be provided or used in the front portion 44 of the pair of pants 10.

Although not shown, the pair of pants 10 could have at least one first wing portion or wrap-around portion 52 and at least one second wing portion or wrap-around portion 54 that wrap around the rear portion of the pants 10 or that wrap around but that do not overlap each other.

Advantageously, the features of the embodiment being described may be used with one or more of the following or have one or more of the following features or advantages:

facilitating easy donning and removing of the pair of outerwear pants while the wearer wears the footwear, skates, cast, leg brace or the like;

wherein the plurality of fasteners includes a plurality of buttons, snaps, buckles, ties, snaps, Velcro or clasps;

wherein the pair of pants are seasonal wear, rain wear, thermal wear, protective wear, layering wear or sports wear;

at least one of a cross wrap (FIG. 12C), an individual leg wrap (FIG. 12B), a skirted wrap or overwrap (FIG. 12D), an asymmetrical wrap, meet in the center wrap (FIG. 12A) or a wrap to the back;

the pants can be full length, capri length or short length;

the pants could also close (or wrap) to the back;

wherein the at least one wrap-around portion comprises a cross wrap, an individual leg wrap, a skirted wrap or overlap;

pants can be worn by themselves. They can also be worn over shorts or pants, or under skirts to provide warmth, coverage, and even rain protection. As such, they would be extremely helpful for someone traveling to and from a gym in cold weather. A person wearing them over shorts and shoes could easily remove the pants upon arrival at the gym and then quickly don them after the activity—all without ever removing his/her footwear. Tennis players, figure skaters, golfers, and winter season athletes would be some of the prime beneficiaries of this invention. Other beneficial users include those who work in rapidly changing environmental conditions, such as military or law enforcement, as well as individuals who, because of lower extremity injuries (casts) or disabilities, need a non-traditional type of pant. Additional uses could be for protective wear, layering wear, medical scrubs, laboratory outerwear, construction workers, could be used for travelers, hikers, gardeners, or any activity where layering is beneficial.

It should be understood that the pants could be of varying lengths, such as long, short or Capri/mid length. It should also be understood that the at least one first wing portion or wrap-around portion 52 and the at least one second wing portion or wrap-around portion 56 could be fixed or integrally formed with the second portion or front portion 44, rather than the first portion or rear portion 42 as shown. Also, the pants can be worn "backwards" so that the second portion or front portion 44 is now covering the buttocks of the wearer and the first portion or rear portion 42 covers the wearer's front, thereby allowing the front of the pants to be completely and continuously covered or closed and the pants 10 wrap to the back. This might be helpful for applications where protection from front to back is necessary, such as in a cooking setting, a lab setting, a medical setting or the like.

While the system and product herein described constitute preferred embodiments of this invention, it is to be understood that the invention is not limited to this precise system and product, and that changes may be made therein without departing from the scope of the invention which is defined in the appended claims.

What is claimed is:

1. A pair of pants that allow a wearer to easily don and remove said pair of pants without said wearer having to remove clothing, apparel, footwear, skates, a cast, a leg brace or the like, said pair of pants comprising:

a waistband that encircles a waist of said wearer of said pair of pants;

a first leg having a first inner leg seam and a first outside leg opening;

a second leg having a second inner leg seam and a second outside leg opening;

a crotch seam between said first and second legs;

said first leg and said second leg being made of a fabric that is slidably supported on said waistband and that define a front and a back of said pair of pants;

at least a portion of said pair of pants enabling said fabric to slidably move on said waistband to enable said wearer to change a size of at least one of said first outside leg opening or said second outside leg opening in order to men or close said at least one of said first outside leg opening or said second outside leg opening;

said waistband being continuous, unbroken, and closed without being tied with a knot when said at least one of said first outside leg opening or said second outside leg opening are in said opened or closed positions.

2. The pair of pants as recited in claim 1 wherein said pair of pants further comprises:

at least one pant piece that is integral with or secured to said fabric, but that moves in response to movement of said fabric on said waistband and that wraps around to said pair of pants to cover at least one of said first outside leg opening or said second outside leg opening;

said at least one pant piece being secured to a closed position with at least one fastener.

3. The pair of pants as recited in claim 1 wherein said pair of pants further comprises:

a first back pant piece;

a second back pant piece;

at least a first portion of each of said first and second back pant pieces being adapted so that they move in response to movement of fabric on said waistband and a second portion that is not supported on said waistband and that wraps around to said front of the pair of pants to cover said first and second outside leg openings, respectively;

said first and second back pant pieces being secured to said front with at least one fastener.

4. The pair of pants as recited in claim 3 wherein said first and second portions are joined together or are integral with each other and define an intermediate piece having a hem that receives said waistband.

5. The pair of pants as recited in claim 1 wherein said fabric is at least one of cotton, fleece, water-proof, water-resistant, or spandex.

6. The pair of pants as recited in claim 1 wherein said waistband is elastic.

7. The pair of pants as recited in claim 6 wherein said waistband is an endless or continuous, one-piece construction.

8. The pair of pants as recited in claim 1 wherein said waistband is an endless or continuous, one-piece construction.

9. The pair of pants as recited in claim 1 wherein said pair of pants is outerwear pants adapted to facilitate easy donning and removal of the pair of pants over other apparel or footwear worn by said wearer.

10. A pair of pants comprising:

a first portion and a second portion;

a waistband; said first portion and said second portion slidably received or mounted on said waistband;

a first leg extending from said first and second portions and having a first leg side opening;

a second leg extending from said first and second portions and having a second leg side opening, said first and second portions adapted to be slidably moved on said waistband to enable a wearer to change a size of at least one of said first leg side opening or said second leg side opening in order to open or dose said at least one of said first leg side opening or said second leg side opening;

said waistband being continuous, unbroken, and closed without being tied with a knot when said at least one of said first outside leg opening or said second outside leg opening are in said opened or closed positions.

11. The pair of pants as recited in claim 10 wherein at least one of said first portion or said second portion have at least one wrap-around portion for wrapping or overlapping said second portion or said first portion, thereby substantially closing said first leg side opening or said second leg side opening, respectively.

12. The pair of pants as recited in claim 11 wherein said first portion comprises a first wrap-around portion and a second wrap-around portion that wraps around the second portion, each of said first and second wrap-around portions are integral with or secured to said first portion and that is not slidably mounted on said waistband, but that moves in response to movement of said first portion on said waistband.

13. The pair of pants as recited in claim 12 wherein said first and second wrap-around portions comprise a fastener for fastening said first and second wrap-around portions to said second portion.

14. The pair of pants as recited in claim 13 wherein said first and second wrap-around portions lie in a first imaginary plane that extends generally perpendicular to an imaginary plane defined by said waistband.

15. The pair of pants as recited in claim 12 wherein said pair of pants comprises a plurality of fasteners for fastening said first wrap-around portion and said second wrap-around portion in a closed or fastened position in order to substantially close or cover said first and second leg side openings.

16. The pair of pants as recited in claim 12 wherein said pair of pants comprise a plurality of fasteners for fastening said first and said second wrap-around portions to said second portion.

17. The pair of pants as recited in claim 10 wherein each of said first portion and said second portion have a seam or hem for receiving said waistband, said seam or hem being adapted to permit said first portion or said second portion to be gathered and moved on said waistband in order to increase or decrease a size of at least one of said first leg side opening or second leg side opening.

18. The pair of pants as recited in claim 10 wherein said waistband is elastic.

19. The pair of pants as recited in claim 18 wherein said waistband is an endless, one-piece construction.

20. The pair of pants as recited in claim 10 wherein said waistband is a continuous elastic waistband.

21. The pair of pants as recited in claim 10 wherein said pair of pants comprises a crotch seam and an inseam but no side seams.

22. The pair of pants as recited in claim 10 wherein said first portion defines a rear panel and said second portion defines a front panel.

23. The pair of pants as recited in claim 10 wherein said first portion comprises a first hem for receiving said waistband and said second portion comprises a second hem for receiving said waistband, said first and second hems each having a first hem end and a second hem end, each of said first hem ends being in communication with said first leg side opening and said second hem ends being associated with said second leg side opening, wherein said first hem ends move toward or away from each other on said waistband, said first leg side opening becomes smaller or larger, respectively, and wherein said second hem ends move toward or away from each other said second leg side opening becomes smaller or larger, respectively.

24. A method for donning a pair of pants having a first leg side opening and a second leg side opening, said method comprising the steps of:

increasing a size of at least one of said first leg side opening or said second leg side opening by either sliding a first portion and a second portion on a waistband or stretching said waistband;

inserting a first leg into said waistband and into one of said first leg side opening or second leg side opening;

sliding said first portion and said second portion on said waistband to increase a size of the other of said first leg side opening or second leg side opening by sliding a first portion and a second portion on a waistband or stretching said waistband;

inserting a second leg into the other of said first leg side opening or second leg side opening;

pulling said waistband over a waist of the wearer;

sliding said first portion and said second portion closer together to close said at least one of said first leg side opening or said second leg side opening;

sliding said first portion and said second portion of the other of said first leg side opening or second leg side opening closer together to close said opening of said first leg side opening or said second leg side opening;

wrapping a first wrap-around portion of at least one of said first portion or second portion about said second portion or first portion, respectively, to substantially close said first leg side opening;

wrapping a second wrap-around portion of at least one of said first portion or second portion about said second portion or first portion, respectively, to substantially close said second leg side opening; said waistband being continuous, unbroken, and closed without being tied with a knot when said at least one of said first outside leg opening or said second outside leg opening are in said opened or closed positions.

25. The method as recited in claim 24 wherein said method further comprises the step of:

moving said first portion and said second portion on said waistband to at least partially close said first leg side opening and second leg side opening before each of said wrapping steps.

26. The method as recited in claim 25 wherein said method further comprises the step of:

fastening each of said first wrap-around portion and said second wrap-around portion in a locked position using at least one fastener.

27. The method as recited in claim 24 wherein said method further comprises the step of: performing said steps of sliding before said steps of wrapping.

28. The method as recited in claim 24 wherein said waistband is a elastic waistband.

29. A pair of pants comprising:

a waistband;

a first portion slidably received or mounted on said waistband; and a second portion slidably received or mounted on said waistband;

said first and second portions being coupled to or integral with a first pant leg having a first side opening and a second pant leg having a second side opening;

said first and second portions being slidably supported on said waistband so that said first and second portions can be slidably moved away from or towards each other on said waistband or said waistband can stretch or contract to enable a wearer to increase or decrease, respectively, a size of at least one of said first side opening or said second side opening to facilitate easy donning and removal of the pair of pants by a wearer while said wearer wears other apparel or footwear;

said waistband being continuous, unbroken, and closed without being tied with a knot when said at least one of said first outside leg opening or said second outside leg opening are in said opened or closed positions.

30. The pair of pants as recited in claim 29 wherein said first portion defines a front portion and said second portion defines a rear portion, at least one of said front portion or said rear portion having a wrap-around portion for wrapping or overlapping said rear portion or said front portion, respectively, to facilitate closing at least one of said first side opening or said second side opening.

31. The pair of pants as recited in claim 30 wherein said wrap-around portion comprises a top area that is not slidably received on said waistband, but that moves in response to movement of fabric on said waistband.

32. The pair of pants as recited in claim 30 wherein said rear portion comprises said wrap-around portion.

33. The pair of pants as recited in claim 30 wherein said rear portion comprises a first wrap-around portion and a second wrap-around portion that wraps in front of said front portion.

34. The pair of pants as recited in claim 33 wherein said first and second wrap-around portions are adapted to be fastened to either said front portion or to each other.

35. The pair of pants as recited in claim 33 wherein said pair of pants comprises a plurality of fasteners for fastening said first wrap-around portion and said second wrap-around portion together in order to substantially close or cover said first and second side openings.

36. The pair of pants as recited in claim 33 wherein said first and second wrap-around portions comprise a plurality of fasteners for fastening said wrap-around portion.

37. The pair of pants as recited in claim 30 wherein said rear portion comprises said wrap-around portion, said wrap-around portion being dimensioned or adapted to overlap said front portion in order to substantially close said first side opening and said second side opening when said wrap-around portion is moved from an open position to a closed position.

38. The pair of pants as recited in claim 29 wherein said waistband is a continuous elastic waistband.

39. The pair of pants as recited in claim 29 wherein each of said first portion and said second portion have a seam or hem for receiving said waistband that is adapted to permit said first portion or said second portion to slide on said waistband.

40. The pair of pants as recited in claim 29 wherein said waistband is elastic.

41. The pair of pants as recited in claim 40 wherein said waistband is an endless, one-piece construction.

42. The pair of pants as recited in claim 29 wherein said pair of pants comprises a crotch seam and an inseam but no side seams so that said waistband is visible on both sides of said pair of pants when opened.

43. The pair of pants as recited in claim 29 wherein said first portion comprises a first edge and a second edge and said second portion comprises a third edge and a fourth edge, said first edge and said third edge cooperating to define a first separation between said first portion and said second portion that is in communication with said first side opening;

said first edge and said third edge being moveable away from or toward each other on said waistband or in response to a stretching or contraction of said waistband to increase or decrease, respectively, a distance between them, thereby increasing or decreasing said size of said first side opening.

44. The pair of pants as recited in claim 43 wherein said second edge and said fourth edge cooperating to define a second separation between said first portion and said second portion that is in communication with said second side opening;

said second edge and said fourth edge being moveable away from or toward each other on said waistband or in response to a stretching or contraction of said waistband to increase or decrease a distance between them, thereby increasing or decreasing, respectively, said size of said second side opening.

45. The pair of pants as recited in claim 29 wherein at least one of said first portion or said second portion have at least one fabric wing attached thereto that moves in response to movement of fabric on said waistband and that can wrap around said pair of pants to facilitate closing at least one of said first side opening and said second side opening.

46. The pair of pants as recited in claim 29 wherein at least one of said first portion or said second portion has a first fabric wing and a second fabric wing attached thereto that move in response to movement of fabric on said waistband and that can wrap around said pair of pants to facilitate closing said at least one of said first side opening or said second side opening, respectively.

47. The pair of pants as recited in claim 46 wherein said first and second fabric wings are secured to or integral with said first portion and wrap from back to front so that said first and second fabric wings overlap an overlapped area of said second portion so that when said first and second fabric wings are secured or fixed, said first and second side openings and said become substantially closed.

48. The pair of pants as recited in claim 47 wherein said waistband is a continuous elastic waistband.

* * * * *